US010783847B2

(12) United States Patent
Tang

(10) Patent No.: US 10,783,847 B2
(45) Date of Patent: Sep. 22, 2020

(54) DISPLAY APPARATUS

(71) Applicant: Au Optronics Corporation, Hsinchu (TW)

(72) Inventor: Lung-Ling Tang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/594,082

(22) Filed: Oct. 7, 2019

(65) Prior Publication Data

US 2020/0184915 A1 Jun. 11, 2020

Related U.S. Application Data

(60) Provisional application No. 62/775,469, filed on Dec. 5, 2018.

(30) Foreign Application Priority Data

Jun. 19, 2019 (TW) ..... 108121280 A

(51) Int. Cl.
*G09G 3/36* (2006.01)
*G09G 3/296* (2013.01)

(52) U.S. Cl.
CPC ..... *G09G 3/3655* (2013.01); *G09G 3/296* (2013.01); *G09G 3/3614* (2013.01); *G09G 2300/0426* (2013.01)

(58) Field of Classification Search
CPC .... G09G 3/3655; G09G 3/296; G09G 3/3614; G09G 2300/0426; G09G 3/20; G09G 3/3266; G09G 3/3677
See application file for complete search history.

(56) References Cited

U.S. PATENT DOCUMENTS

| | | | | |
|---|---|---|---|---|
| 7,511,778 | B2 | 3/2009 | Baek | |
| 8,767,024 | B2 | 7/2014 | Wang et al. | |
| 2005/0012872 | A1 | 1/2005 | Baek | |
| 2006/0119596 | A1 | 6/2006 | Lin | |
| 2009/0207113 | A1* | 8/2009 | Lee | G09G 3/3648 345/87 |

(Continued)

FOREIGN PATENT DOCUMENTS

| | | |
|---|---|---|
| CN | 105511184 | 4/2016 |
| TW | 200528811 | 9/2005 |

*Primary Examiner* — Premal R Patel
(74) *Attorney, Agent, or Firm* — JCIPRNET

(57) ABSTRACT

A display apparatus includes pixels and a gate driver. The pixels include N pixels arranged in order, and N is a positive integer greater than or equal to 2. The N pixels include a $p^{th}$ pixel and a $q^{th}$ pixel, wherein p is an odd number less than or equal to N and a positive integer, and q is an even number less than or equal to N and a positive integer. The gate driver is electrically connected to a scan line of the $p^{th}$ pixel and receives a first start signal to generate a first gate pulse signal in a first sub-frame interval of a frame interval. The gate driver is electrically connected to a scan line of the $q^{th}$ pixel and receives a second start signal to generate a second gate pulse signal in a second sub-frame interval of the frame interval following the first sub-frame interval.

17 Claims, 10 Drawing Sheets

(56) References Cited

U.S. PATENT DOCUMENTS

| | | | | |
|---|---|---|---|---|
| 2013/0009938 | A1* | 1/2013 | Hwang | G09G 3/3644 345/212 |
| 2013/0222218 | A1* | 8/2013 | Song | G09G 3/3659 345/87 |
| 2015/0170590 | A1* | 6/2015 | Ahn | G09G 3/3614 345/96 |
| 2015/0348481 | A1* | 12/2015 | Hong | G09G 3/3685 345/690 |
| 2017/0047025 | A1* | 2/2017 | Yun | G09G 3/3659 |
| 2017/0177154 | A1* | 6/2017 | Choo | G06F 3/0412 |
| 2017/0186386 | A1* | 6/2017 | Hong | G09G 3/3614 |
| 2018/0039114 | A1 | 2/2018 | Xu | |

* cited by examiner

DISPLAY APPARATUS

CROSS-REFERENCE TO RELATED APPLICATION

This application claims the priority benefits of U.S. provisional application Ser. No. 62/775,469, filed on Dec. 5, 2018, and Taiwan application serial no. 108121280, filed on Jun. 19, 2019. The entirety of each of the above-mentioned patent applications is hereby incorporated by reference herein and made a part of this specification.

BACKGROUND

Technical Field

The disclosure relates to an electronic apparatus, and particularly to a display apparatus.

Description of Related Art

With the progress of display technologies, display apparatuses have been widely used in daily lives, such as home audio-visual entertainment, information display boards in public places, displays for electronic sports, and portable electronic products.

Generally, a display apparatus includes a pixel array substrate, an opposite substrate, and a display medium disposed between the pixel array substrate and the opposite substrate. The pixel array substrate has a plurality of pixels. In order to improve the resolution of the display apparatus, more pixels must be arranged in a unit area. That is, the distance between a pixel electrode and a data line of a pixel is reduced. When the distance between the pixel electrode and the data line is short, the coupling capacitance of the pixel electrode and the data line is large, which causes a vertical cross-talk phenomenon.

SUMMARY

The disclosure provides a display apparatus which is good in performance.

A display apparatus of an embodiment of the disclosure includes a substrate, pixels arranged on the substrate, and a gate driver. Each pixel includes a scan line, a data line, a first switching element and a first pixel electrode. The first switching element has a first end, a second end, and a control end. The first end of the first switching element is electrically connected to the data line. The control end of the first switching element is electrically connected with the scan line. The first pixel electrode is electrically connected with the second end of the first switching element. The pixels include N pixels arranged in order, N is a positive integer greater than or equal to 2, the N pixels include a $p^{th}$ pixel and a $q^{th}$ pixel, p is an odd number less than or equal to N, p is a positive integer, q is an even number less than or equal to N, and q is a positive integer. The gate driver is electrically connected to a scan line of the $p^{th}$ pixel, where the gate driver receives a first start signal to generate a first gate pulse signal in a first sub-frame interval of a frame interval. The gate driver is electrically connected to a scan line of the $q^{th}$ pixel, where the gate driver receives a second start signal to generate a second gate pulse signal in a second sub-frame interval of the frame interval following the first sub-frame interval. The first gate pulse signal has a first enabling time width, the second gate pulse signal has a second enabling time width, and the first enabling time width is different from the second enabling time width.

A display apparatus of an embodiment of the disclosure includes a substrate, pixels arranged on the substrate, and a gate driver. Each pixel includes a scan line, a data line, a first switching element, a first pixel electrode, a second switching element, a second pixel electrode, a third switching element, a control line and a charging updating capacitor. The first switching element has a first end, a second end, and a control end, where the first end of the first switching element is electrically connected to the data line, and the control end of the first switching element is electrically connected to the scan line. The first pixel electrode is electrically connected to the second end of the first switching element. The second switching element has a first end, a second end, and a control end. The first end of the second switching element is electrically connected to the data line. The control end of the second switching element is electrically connected to the scan line. The second end of the second switching element is electrically connected to the second pixel electrode. The third switching element has a first end, a second end, and a control end. The first end of the third switching element is electrically connected to the second end of the second switching element. The control end of the third switching element is electrically connected to the control line. The second end of the third switching element is electrically connected to the charging updating capacitor. The pixels include N pixels arranged in order, N is a positive integer greater than or equal to 2, the N pixels include a $p^{th}$ pixel and a $q^{th}$ pixel, p is an odd number less than or equal to N, p is a positive integer, q is an even number less than or equal to N, and q is a positive integer. The gate driver is electrically connected to a scan line of the $p^{th}$ pixel, where the gate driver receives a first start signal to generate a first gate pulse signal in a first sub-frame interval of a frame interval. The gate driver is electrically connected to a scan line of the $q^{th}$ pixel, where the gate driver receives a second start signal to generate a second gate pulse signal in a second sub-frame interval of the frame interval following the first sub-frame interval.

In order to make the aforementioned features and advantages of the disclosure comprehensible, embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

Figure 1:
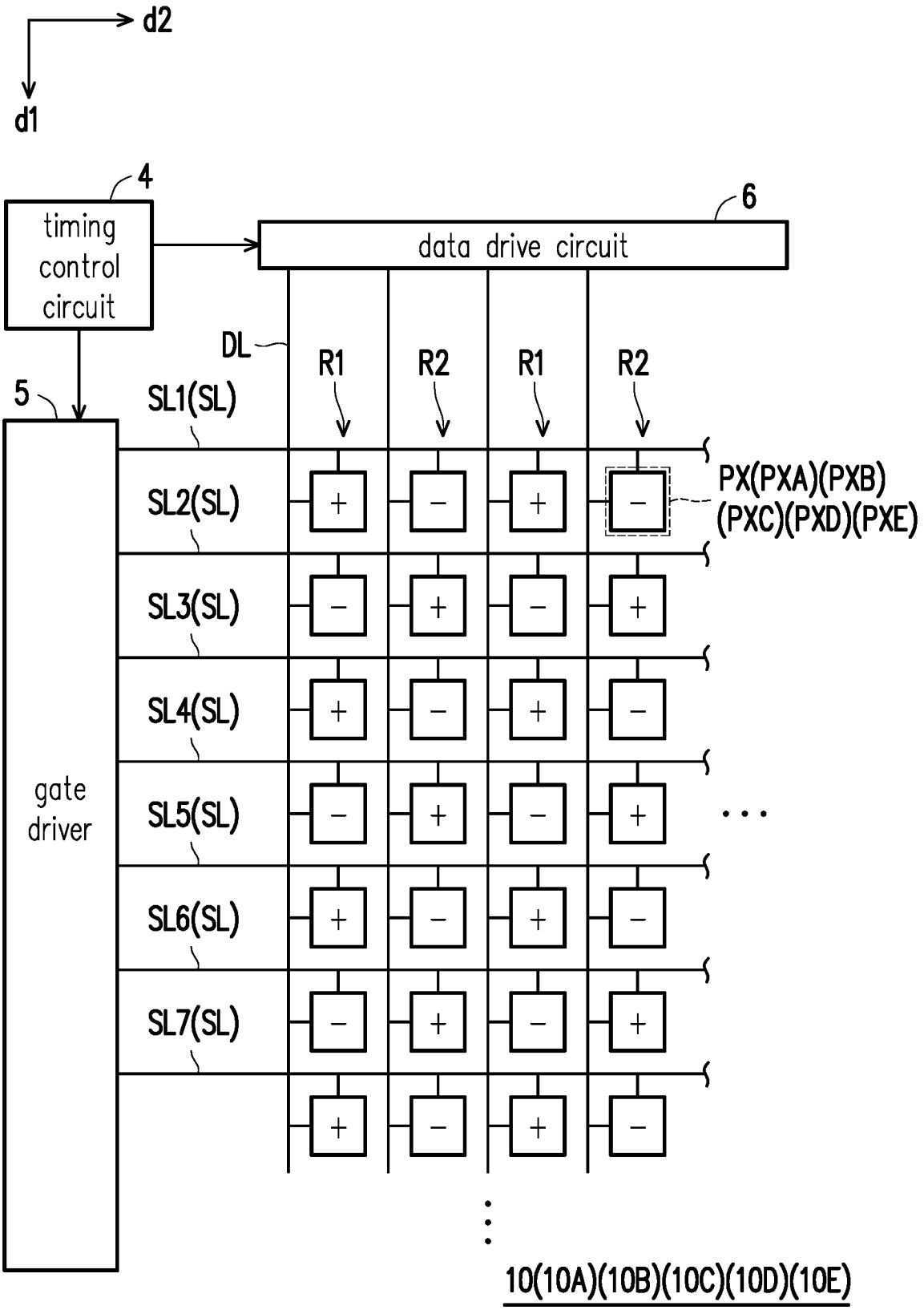
FIG. 1 is a schematic diagram of a display apparatus according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

In the accompanying drawings, the thicknesses of layers, films, panels, regions, and the like are enlarged for clarity. Throughout the specification, same reference numerals indicate same components. It should be understood that when a component such as a layer, film, region or substrate is referred to as being "on" or "connected" to another component, it may be directly on or connected to the another component, or intervening components may also be present. In contrast, when a component is referred to as being "directly on" or "directly connected to" another component, there are no intervening assemblies present. As used herein, "connection" may refer to a physical and/or electrical connection. In addition, an "electrical connection" or "coupling" may be the another component between two components.

As used herein, "about", "approximately", or "substantially" is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, ±20%, ±10%, ±5% of the stated value. Further, as used herein, "about", "approximately", or "substantially" may depend on optical properties, etch properties, or other properties to select a more acceptable range of deviations or standard deviations without one standard deviation for all properties.

Unless otherwise defined, all terms (including technical and scientific terms) used herein have the same meaning as commonly understood by one of ordinary skill in the art to which the disclosure belongs. It will be further understood that terms such as those defined in commonly used dictionaries should be interpreted as having a meaning that is consistent with their meaning in the context of the relevant art and the disclosure and will not be interpreted in an idealized or overly formal sense unless expressly so defined herein.

FIG. 1 is a schematic diagram of a display apparatus according to an embodiment of the disclosure.

Figure 2:
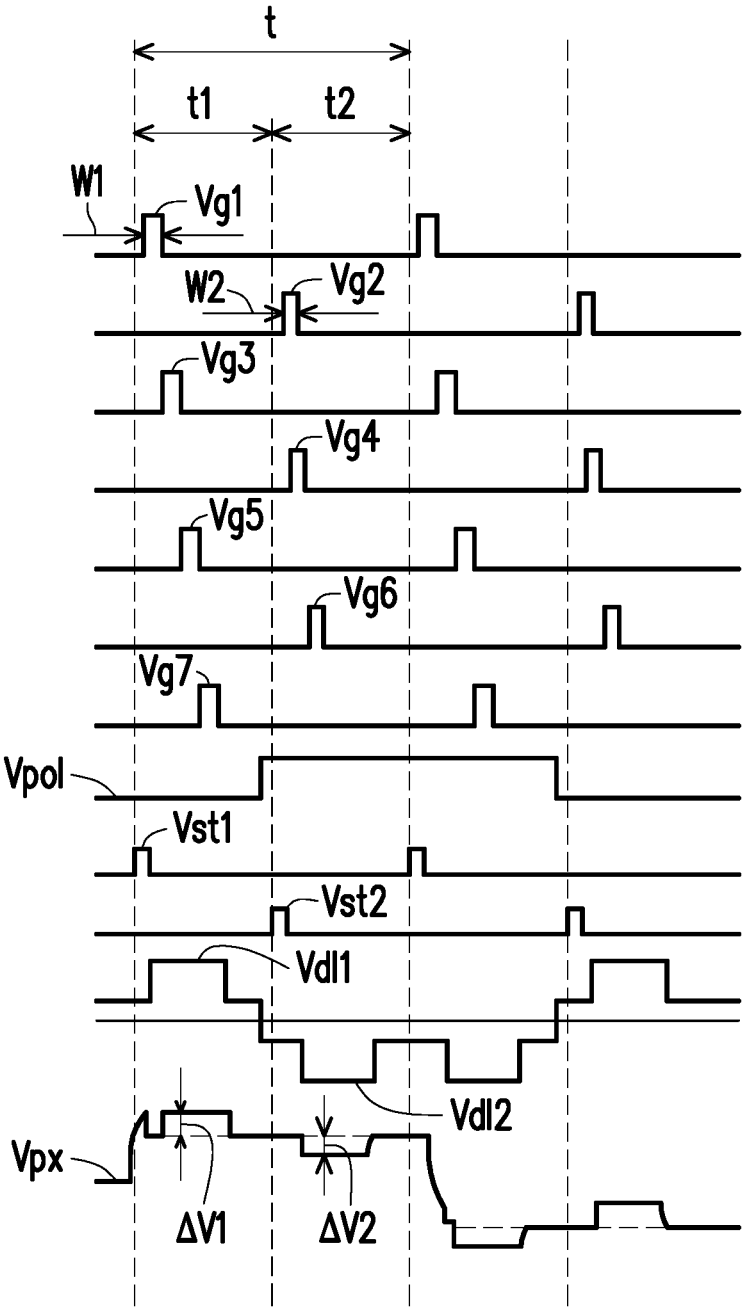
FIG. 2 illustrates first gate pulse signals Vg1, Vg3, Vg5 and Vg7, second gate pulse signals Vg2, Vg4 and Vg6, a polarity signal Vpol, a first start signal Vst1, a second start signal Vst2, a first data signal Vd11, a second data signal Vd12 and a signal Vpx of a pixel electrode according to an embodiment of the disclosure.

FIG. 2 illustrates first gate pulse signals Vg1, Vg3, Vg5 and Vg7, second gate pulse signals Vg2, Vg4 and Vg6, a polarity signal Vpol, a first start signal Vst1, a second start signal Vst2, a first data signal Vd11, a second data signal Vd12, and a signal Vpx of a pixel electrode according to an embodiment of the disclosure.

Figure 3:
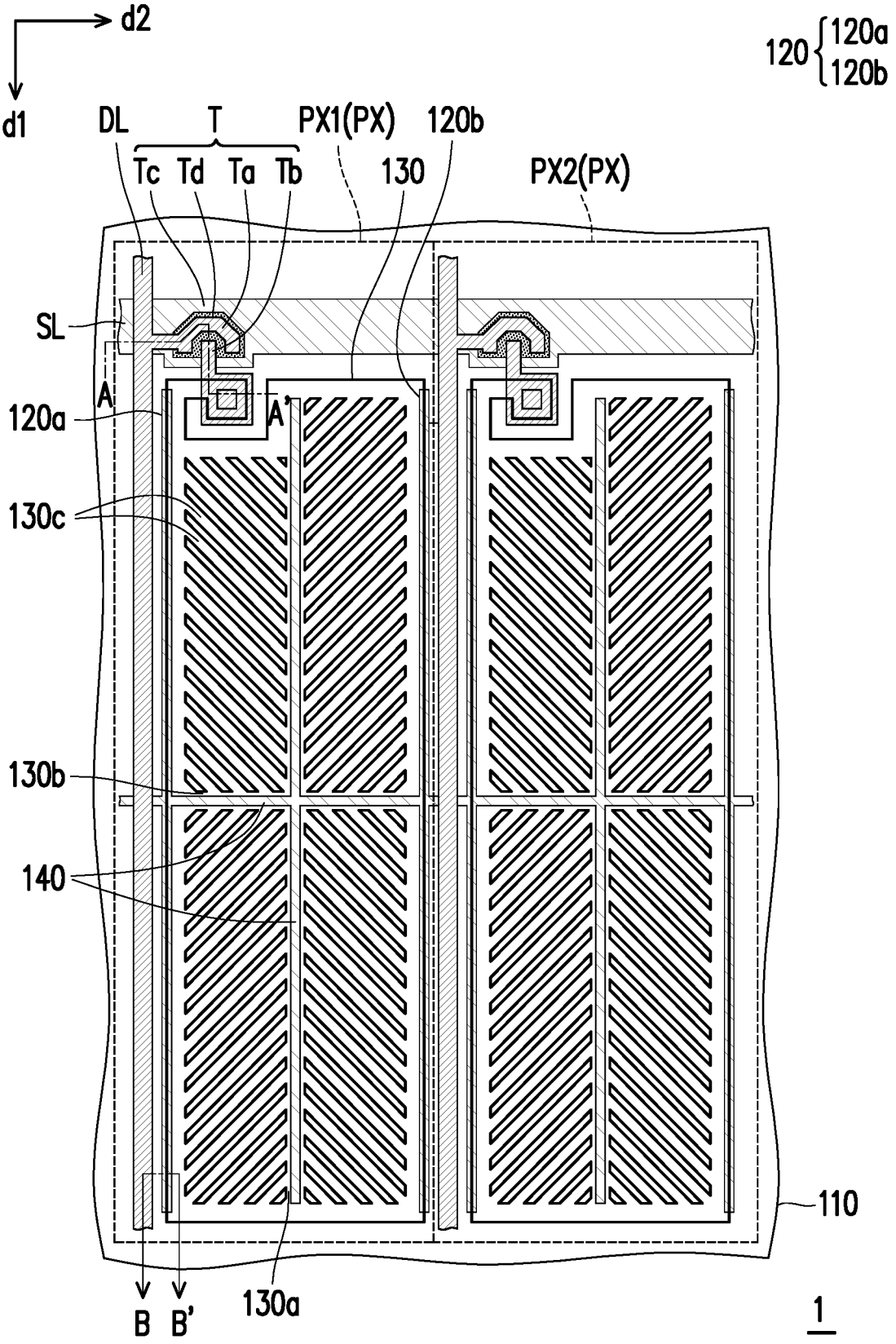
FIG. 3 is a layout diagram of a pixel PX according to an embodiment of the disclosure.

FIG. 3 is a diagram illustrating a layout of a pixel PX according to an embodiment of the disclosure. FIG. 1 omits a depiction of a substrate 110 of FIG. 3.

Figure 4:
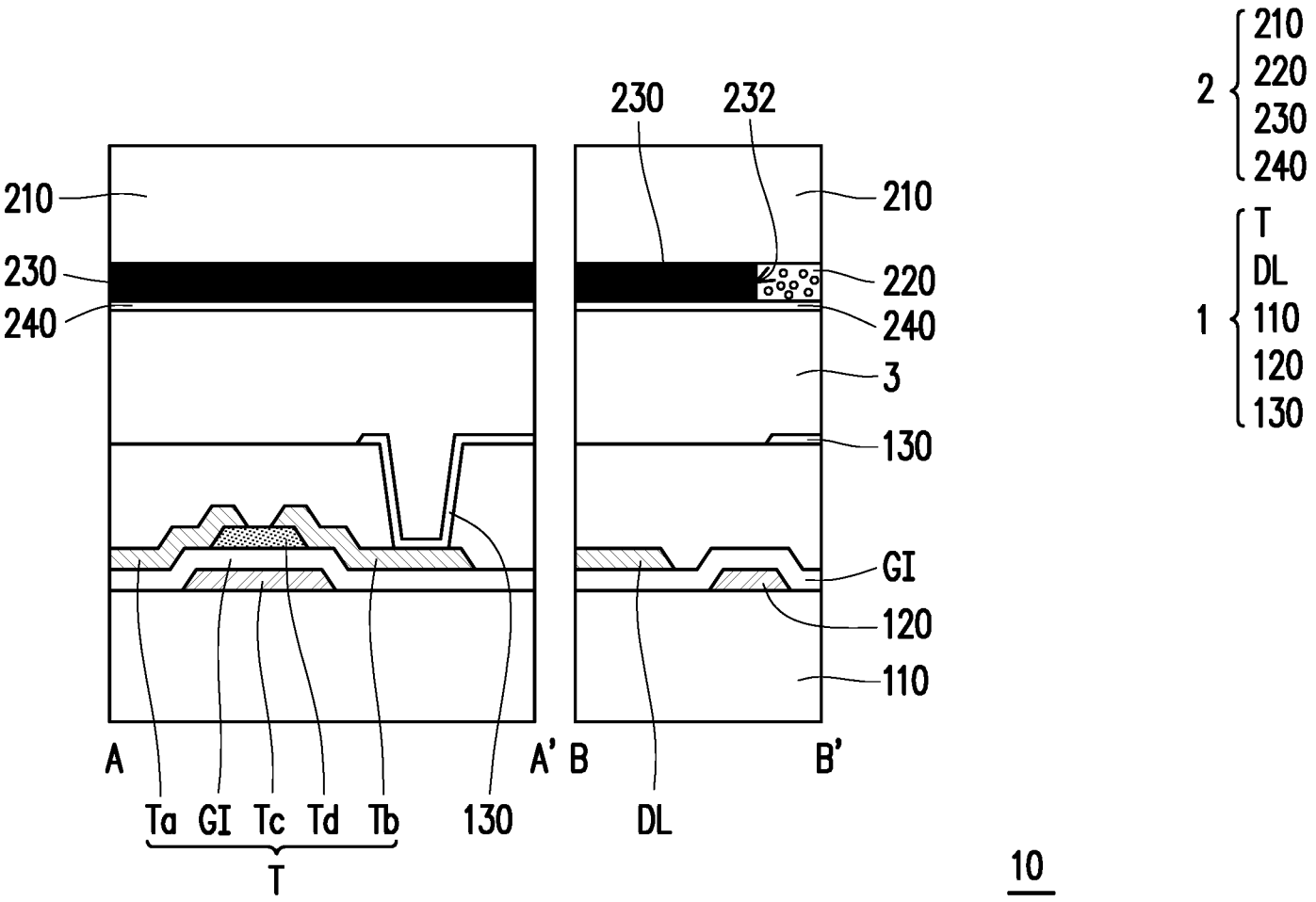
FIG. 4 is a schematic cross-sectional view of a display apparatus according to an embodiment of the disclosure.

FIG. 4 is a schematic cross-sectional view of a display apparatus according to an embodiment of the disclosure. The cross-section of a pixel array substrate 1 of FIG. 4 corresponds to section lines A-A' and B-B' of FIG. 3.

Referring to FIG. 1, FIG. 3 and FIG. 4, a display apparatus 10 includes a pixel array substrate 1, an opposite substrate 2 opposite to the pixel array substrate 1, and a display medium 3 disposed between the pixel array substrate 1 and the opposite substrate 2.

In the present embodiment, the opposite substrate 2 may optionally include a substrate 210, a light blocking pattern 230, and a color filter layer 220. The light blocking pattern 230 is commonly referred to as a black matrix. The light blocking pattern 230 is arranged on the substrate 210 and has a plurality of openings 232. The color filter layer 220 is arranged on the substrate 210 and is overlapped with the openings 232 of the light blocking pattern 230. However, the disclosure is not limited thereto, and according to other embodiments, the color filter layer 220 and/or the light blocking pattern 230 may be arranged on the substrate 110 of the pixel array substrate 1 to form a structure of a color filter on array (COA) and/or a black matrix on array (BOA).

In the present embodiment, the display medium 3 may be a non-self-luminescent material, such as but not limited to: liquid crystal. However, the disclosure is not limited thereto, and according to other embodiments, the display medium 3 may also be a self-luminescent material, such as but not limited to: an organic electroluminescent material and a micro light emitting diode (μLED).

The pixel array substrate 1 includes a substrate 110 and a plurality of pixels PX arranged on the substrate 110. Each pixel PX includes a scan line SL, a data line DL, a switching element T, and a pixel electrode 130. The data line DL extends in a first direction d1, and the scan line SL extends in a second direction d2, where the first direction d1 is staggered from the second direction d2. The switching element T includes a control end Tc, a gate insulating layer GI, a semiconductor pattern Td, a first end Ta and a second end Tb. The gate insulating layer GI is arranged between the control end Tc and the semiconductor pattern Td. The first end Ta and the second end Tb are electrically connected to two different regions of the semiconductor pattern Td, respectively. The first end Ta of the switching element T is electrically connected to the data line DL. The control end Tc of the switching element T is electrically connected to the scan line SL. A pixel electrode 130 is electrically connected to the second end Tb of the switching element T.

Referring to FIG. 3, in the present embodiment, at least one pixel PX includes a shielding conductive pattern 120. The shielding conductive pattern 120 is arranged between the data line DL of the pixel PX and the pixel electrode 130 of the pixel PX. That is, at least a portion of the vertical projection of the shielding conductive pattern 120 on the substrate 110 is located between the vertical projection of the data line DL on the substrate 110 and the vertical projection of the pixel electrode 130 on the substrate 110.

For example, in the present embodiment, the shielding conductive pattern 120 may include a first shielding conductive portion 120*a* and a second shielding conductive portion 120*b*, the first shielding conductive portion 120*a* is arranged between the data line DL and the pixel electrode 130 of the same pixel PX1, and the second shielding conductive portion 120*b* is arranged between the pixel electrode 130 of one pixel PX1 and the data line DL of another pixel PX2. In the present embodiment, the first shielding conductive portion 120*a* and the second shielding conductive portion 120*b* extend in the first direction d1. That is, in the present embodiment, the first shielding conductive portion 120*a*, the second shielding conductive portion 120*b*, and the data line DL may be parallel approximately, but the disclosure is not limited thereto.

In the present embodiment, the first shielding conductive portion 120*a* may be partially overlapped with the pixel electrode 130, and the second shielding conductive portion 120*b* may be partially overlapped with the pixel electrode 130. However, the disclosure is not limited thereto, and according to other embodiments, the first shielding conductive portion 120*a* and/or the second shielding conductive portion 120*b* may be not overlapped with the pixel electrode 130.

Referring to FIG. 3 and FIG. 4, in the present embodiment, the shielding conductive pattern 120 and the scan line SL may be manufactured together. That is, the shielding conductive pattern 120 and the scan line SL may be formed on the same conductive layer, and the material of the shielding conductive pattern 120 and the material of the scan line SL may be the same.

Based on consideration on conductivity, the scan line SL is generally made of a metallic material. However, the disclosure is not limited thereto, and according to other embodiments, the scan line SL may also be made of other conductive materials such as alloys, nitrides of metallic materials, oxides of metallic materials, oxynitrides of metallic materials, or stacked layers of metallic materials and other conductive materials.

In the present embodiment, the shielding conductive pattern 120 has a predetermined potential including a fixed potential (such as OV, ground or floating potential) or an adjustable non-zero potential.

In the present embodiment, the pixel PX further includes a common electrode 240 (drawn in FIG. 4). The potential difference between the common electrode 240 and the pixel electrode 130 is used to drive the display medium 3.

For example, in the present embodiment, the display apparatus 10 may be a multi-domain vertical alignment (MVA) type liquid crystal display, the pixel electrode 130 includes a first main portion 130*a* (drawn in FIG. 3), a second main portion 130*b* (drawn in FIG. 3) staggered from the first main portion 130*a*, and a plurality of branch portions 130*c* (drawn in FIG. 3) connected to the first main portion 130*a* and the second main portion 130*b*, and the pixel electrode 130 and the common electrode 240 may be arranged on two substrates 110 and 210 which are opposite, respectively. However, the disclosure is not limited thereto, and according to other embodiments, the pixel electrode 130 may be in other shapes and/or the pixel electrode 130 and the common electrode 240 may be arranged on the same substrate.

In the present embodiment, the pixel PX may optionally include a shielding electrode 140 (drawn in FIG. 3). The shielding electrode 140 is overlapped with the first main portion 130*a* and the second main portion 130*b* of the pixel electrode 130. In the present embodiment, the shielding electrode 140 and the shielding conductive pattern 120 may be formed on the same conductive layer, and the shielding electrode 140 may be connected between the first shielding conductive portion 120*a* and the second shielding conductive portion 120*b*, but the disclosure is not limited thereto.

Referring to FIG. 1, the display apparatus 10 further includes a drive system for driving a plurality of pixels PX. The drive system may include a timing control circuit 4, a gate driver 5 and a data drive circuit 6. The timing control circuit 4 is electrically connected with the gate driver 5 and the data drive circuit 6. The gate driver 5 is electrically connected with the scan lines SL of the pixels PX. The data drive circuit 6 is electrically connected with the data lines DL of the pixels PX.

The pixels PX are arranged into a pixel array. In the embodiment of FIG. 1, the gate driver 5 may be selectively arranged on a single side of the pixel array. However, the disclosure is not limited thereto, and according to other embodiments, the gate drivers 5 may be arranged on two opposite sides of the pixel array.

The pixels PX include N pixels PX arranged in order in the first direction d1. N is a positive integer greater than or equal to 2. The N pixels include a $p^{th}$ pixel PX and a $q^{th}$ pixel PX, p is an odd number less than or equal to N, p is a positive integer, q is an even number less than or equal to N, and q is a positive integer. In brief, the N pixels PX arranged in order in the first direction d1 include odd-numbered pixels PX and even-numbered pixels PX.

For example, the pixels PX arranged in order in the first direction d1 include 1st, 3rd, 5th, 7th . . . pixels PX and 2nd, 4th, 6th . . . pixels PX, where the 1st, 3rd, 5th. 7th . . . pixels PX include scan lines SL1, SL3, SL5, SL7 . . . , respectively, and 2nd, 4th and 6th pixels PX include scan lines SL2, SL4, SL6 . . . respectively.

Referring to FIG. 1 and FIG. 2, in a first sub-frame interval t1 of a frame interval t, the gate driver 5 receives a first start signal Vst1 from the timing control circuit 4 to generate a plurality of first gate pulse signals Vg1, Vg3, Vg5, Vg7 . . . . In the first sub-frame interval t1, the first gate pulse signals Vg1, Vg3, Vg5, Vg7 . . . are transmitted to the scan lines SL1, SL3, SL5, SL7 . . . of the odd-numbered pixels PX in a timing sequence.

In a second sub-frame interval t2 of the same frame interval t following the first sub-frame interval t1, the gate driver 5 receives a second start signal Vst2 to generate a plurality of second gate pulse signals Vg2, Vg4, Vg6 . . . , where the second gate pulse signals Vg2, Vg4, Vg6 . . . are transmitted to the scan lines SL2, SL4, SL6 . . . of the even-numbered pixels PX in a timing sequence.

In the first sub-frame interval t1 and the second sub-frame interval t2, the timing control circuit 4 outputs a polarity signal Vpol to the data drive circuit 6. The polarity signal Vpol is switched from a first voltage level to a second voltage level after the scan lines SL1, SL3, SL5, SL7 . . . of the odd-numbered pixels PX receive the first gate pulse signals Vg1, Vg3, Vg5, Vg7 . . . and before the scan lines SL2, SL4, SL6 . . . of the even-numbered pixels PX receive the second gate pulse signals Vg2, Vg4, Vg6 . . . .

The data drive circuit 6 receives the polarity signal Vpol to respectively output a first data signal Vd11 and a second data signal Vd12 to the same data line DL in the first sub-frame interval t1 and the second sub-frame interval t2, where the polarity of the first data signal Vd11 is opposite to that of the second data signal Vd12. For example, in the present embodiment, the pixel array includes a plurality of pixel rows R1 and R2 arranged in the second direction d2, and a plurality of pixels PX of each of the pixel rows R1 and R2 are sequentially arranged in the first direction d1; the pixel rows R1 and R2 include a plurality of odd-numbered pixel rows R1 and a plurality of even-numbered pixel rows R2 which are alternately arranged in the second direction d2; in the first sub-frame interval t1, the odd-numbered pixels PX of the odd-numbered pixel rows R1 have a first polarity (such as a positive polarity), and the odd-numbered pixels PX of the even-numbered pixel rows R2 have a second polarity (such as a negative polarity); in the second sub-frame interval t2, the even-numbered pixels PX of the odd-numbered pixel rows R1 have the second polarity (such as the negative polarity), and the even-numbered pixels PX of the even-numbered pixel rows R2 have the first polarity (such as the positive polarity); but the disclosure is not limited thereto.

Thus, the pixel electrode 130 is coupled to the data line DL, of which the polarity is opposite to that of the pixel electrode 130, in the first sub-frame interval t1 and the second sub-frame interval t2, respectively. Voltage difference ΔV1 and voltage difference ΔV2 of a signal Vpx of the pixel electrode 130, which are caused by capacitive coupling of the data line DL and the pixel electrode 130 in the first sub-frame interval t1 and the second sub-frame interval t2, respectively, compensate to each other, which relieves the vertical cross-talk phenomenon.

It is worth noting that, the first gate pulse signals Vg1, Vg3, Vg5, Vg7 . . . have a first enabling time width W1 which refers to the length of time when the first gate pulse signals Vg1, Vg3, Vg5, Vg7 . . . have gate switch-on potentials, and the second gate pulse signals Vg2, Vg4, Vg6 . . . have a second enabling time width W2 which refers to the length of time when the second gate pulse signals Vg2, Vg4, Vg6 . . . have gate switch-on potentials, and the first enabling time width W1 is different from the second enabling time width W2.

That is, the pixel electrode 130 of each pixel PX, the common electrode 240 and the display medium 3 may form a display capacitor, and the display capacitors of the odd-numbered pixels PX and the display capacitors of the even-numbered pixels PX are charged in the first sub-frame interval t1 and the second sub-frame interval t2 following the first sub-frame interval t1, respectively, and the charging time of the display capacitors of the odd-numbered pixels PX is different from the charging time of the display capacitors of the even-numbered pixels PX. Therefore, poor display caused by leakage of the switching elements T may be avoided.

For example, in the present embodiment, $0.05 \leq |W1-W2|/W1 \leq 0.30$ Specifically, the first enabling time width W1 and/or the second enabling time width W2 may be between 12 microseconds (μs) and 14 microseconds, but the disclosure is not limited thereto.

Figure 5:
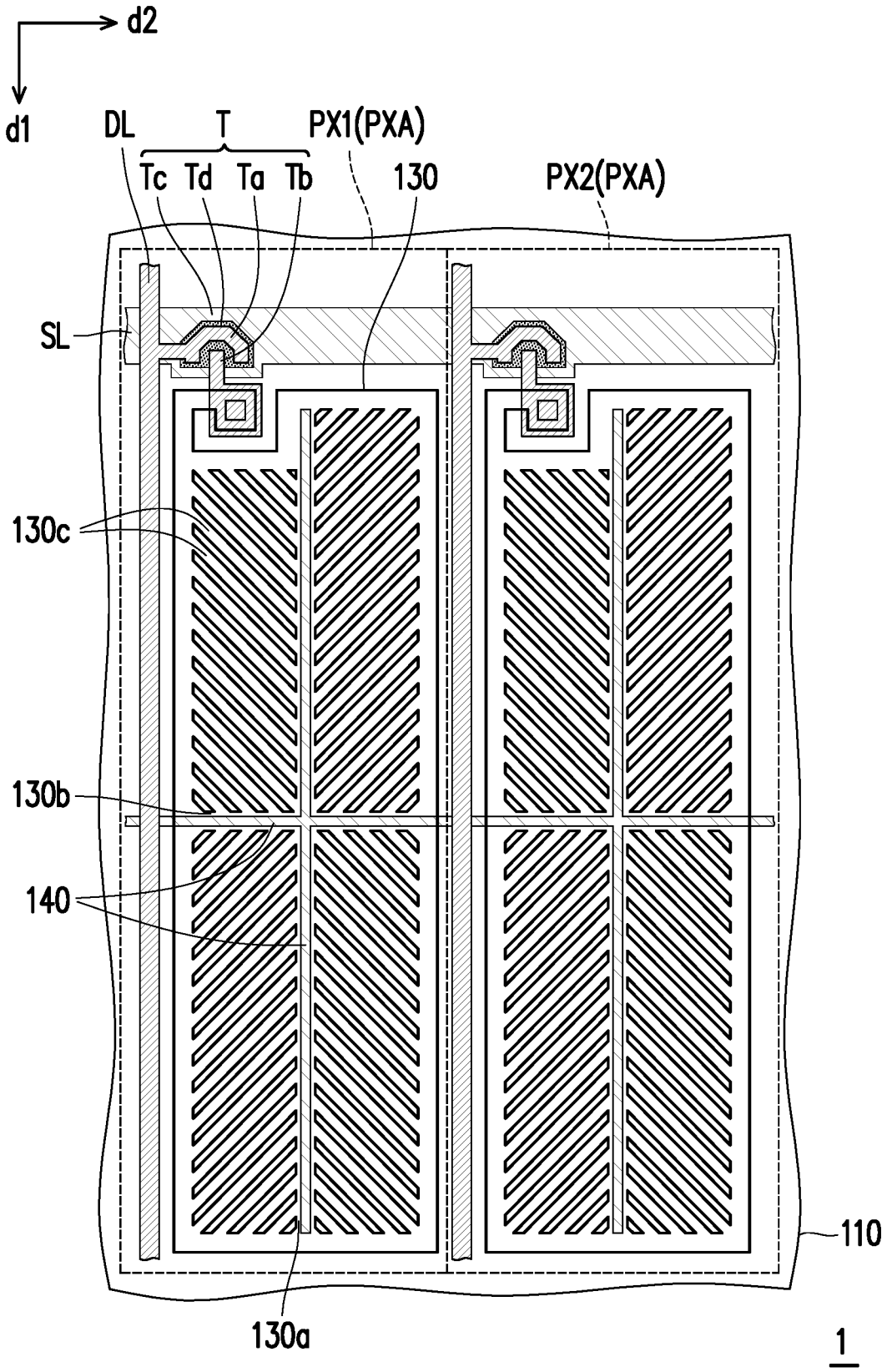
FIG. 5 is a schematic layout diagram of a pixel PXA according to another embodiment of the disclosure.

FIG. 5 is a layout diagram of a pixel PXA according to another embodiment of the disclosure. The pixel PXA of FIG. 5 is similar to the pixel PX of FIG. 3, and the difference between the pixel PXA of FIG. 5 and the pixel PX of FIG. 3 is as follows: the pixel PXA of FIG. 5 does not include the shielding conductive pattern 120 of the pixel PX of FIG. 3. That is, in the embodiment of FIG. 5, no shielding conductive pattern extending in the first direction d1 is arranged between the data line DL and the pixel electrode 130.

The pixels PXA of FIG. 5 may be used in place of the pixels PX of FIG. 1 to form another display apparatus 10A. The display apparatus 10A including a plurality of pixels PXA may also be driven by the foregoing drive system. In particular, the pixel PXA does not include the shielding conductive pattern 120 and the display apparatus 10A has a high aperture ratio, and the vertical cross-talk phenomenon may be relieved on the premise of having the high aperture ratio by the display apparatus 10A which is matched with the foregoing drive system.

Figure 6A:
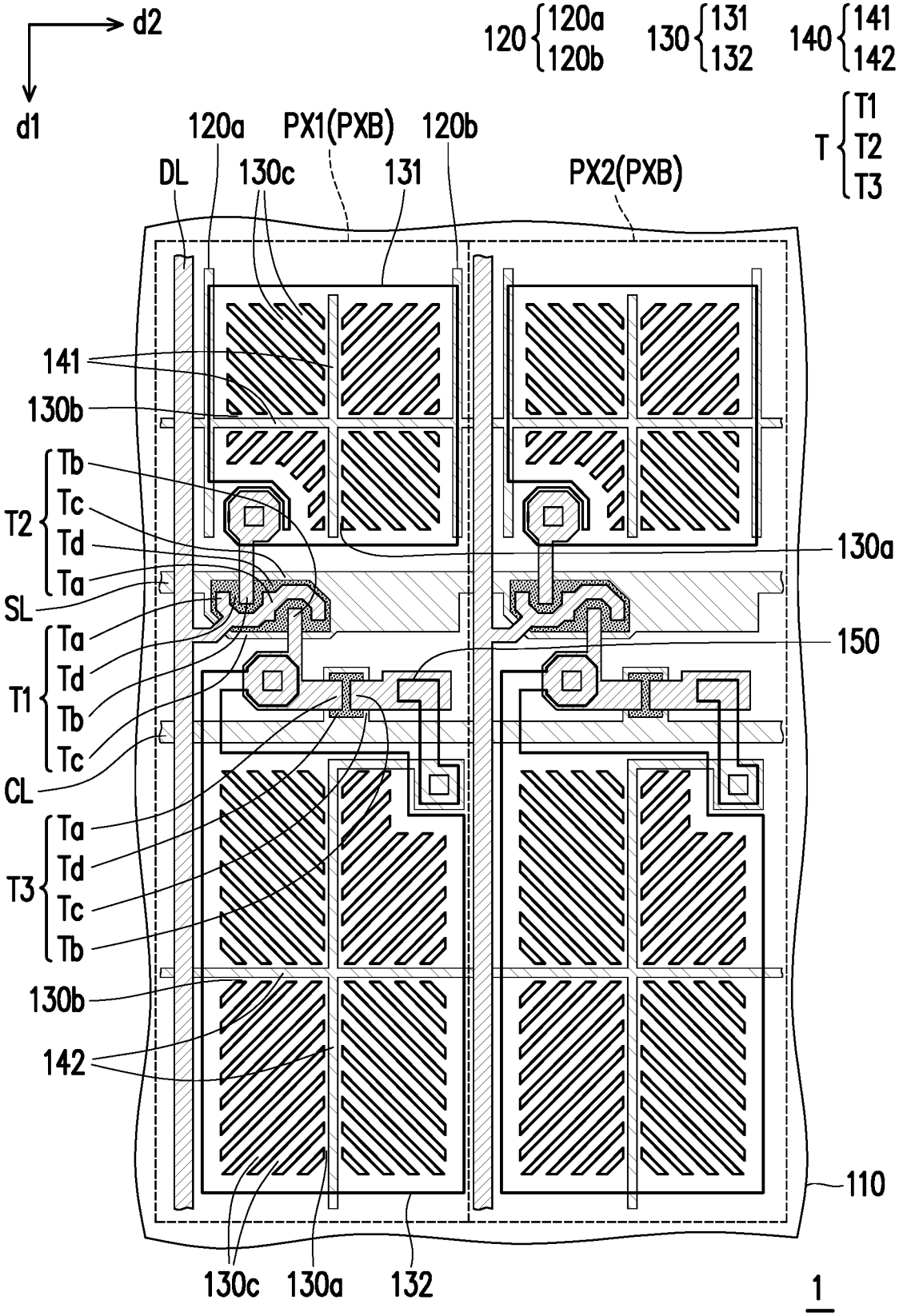
FIG. 6A is a circuit diagram of a pixel PXB according to yet another embodiment of the disclosure.
Figure 6B:
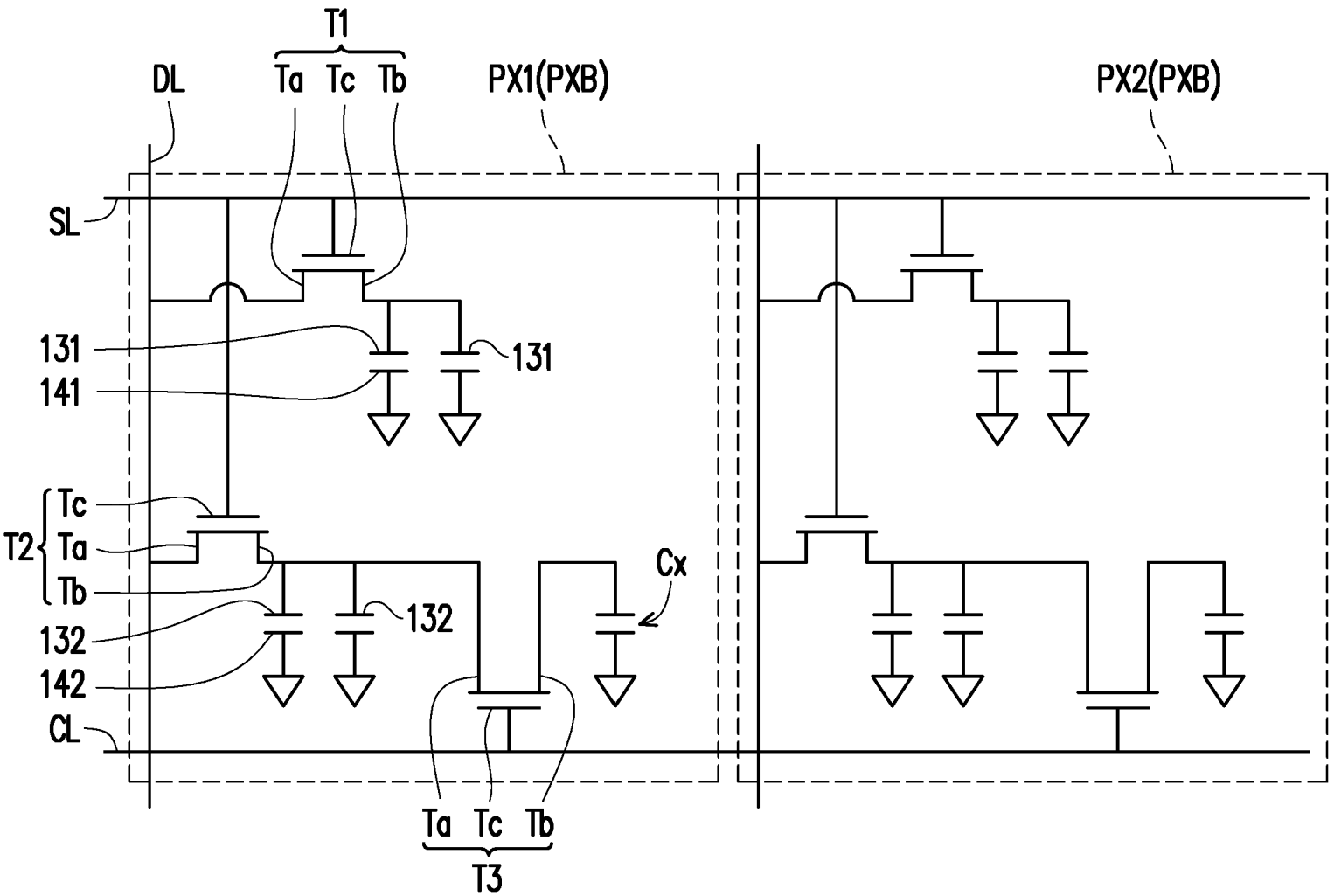
FIG. 6B is a layout diagram of a pixel PXB according to yet another embodiment of the disclosure.

FIG. 6A is a circuit diagram of a pixel PXB according to yet another embodiment of the disclosure. FIG. 6B is a layout diagram of a pixel PXB according to yet another embodiment of the disclosure. The pixels PXB of FIG. 6A and the pixels PXB of FIG. 6B are similar to the pixels PX of FIG. 3, and the difference between the pixels PXB of FIG. 6A and FIG. 6B and the pixels PX of FIG. 3 is stated as follows.

Referring to FIG. 6A and FIG. 6B, in the present embodiment, each pixel PXB includes a scan line SL, a data line DL, a control line CL, a switching element T and a pixel electrode 130. The switching element T includes a first switching element T1, a second switching element T2 and a third switching element T3, and the pixel electrode 130 includes a first pixel electrode 131 and a second pixel electrode 132.

The first switching element T1 includes a control end Tc, a first end Ta and a second end Tb. The first end Ta of the first switching element T1 is electrically connected to the data line DL. The control end Tc of the first switching element T1 is electrically connected to the scan line SL. The first pixel electrode 131 is electrically connected to the second end Tb of the first switching element T1.

The second switching element T2 has a first end Ta, a second end Tb and a control end Tc. The first end Ta of the second switching element T2 is electrically connected to the data line DL. The control end Tc of the second switching element T2 is electrically connected to the scan line SL. The second end Tb of the second switching element T2 is electrically connected to the second pixel electrode 132.

The third switching element T3 has a first end Ta, a second end Tb and a control end Tc. The first end Ta of the third switching element T3 is electrically connected to the second end Tb of the second switching element T2. The control end Tc of the third switching element T3 is electrically connected to the control line CL. In the present embodiment, the control line CL may extend in the second direction d2, and the control line CL may be parallel to the scan line SL approximately, but the disclosure is not limited thereto.

In the present embodiment, the pixel PXB further includes a shielding electrode 140. The shielding electrode 140 includes a first shielding electrode 141 and a second shielding electrode 142. The first shielding electrode 141 is overlapped with the first main portion 130*a* and the second main portion 130*b* of the first pixel electrode 131. The second shielding electrode 142 is overlapped with the first main portion 130*a* and the second main portion 130*b* of the second pixel electrode 132.

The second shielding electrode 142 is overlapped with the second pixel electrode 132 to form a charging updating capacitor Cx. The second end Tb of the third switching element T3 is electrically connected to one electrode (namely the second shielding electrode 142) of the charging updating capacitor Cx.

For example, in the present embodiment, the pixel PXB further includes a connection pattern 150, where the connection pattern 150 and the pixel electrode 130 may be formed on the same film layer, and the second end Tb of the third switching element T3 may be electrically connected to the second shielding electrode 142 through the connection pattern 150, but the disclosure is not limited thereto.

In the present embodiment, the pixel PXB includes a shielding conductive pattern 120. The shielding conductive pattern 120 is arranged between the data line DL of the pixel PX and the first pixel electrode 131 of the pixel PX. That is, at least a part of the vertical projection of the shielding conductive pattern 120 on the substrate 110 is located between the vertical projection of the data line DL on the substrate 110 and the vertical projection of the first pixel electrode 131 on the substrate 110.

The pixels PXB include pixels PX1 and pixels PX2 which are arranged and adjacent to each other in the second direction d2. For example, in the present embodiment, the shielding conductive pattern 120 may include a first shielding conductive portion 120*a* and a second shielding conductive portion 120*b*, the first shielding conductive portion 120*a* is arranged between the data line DL and the first pixel electrode 131 of the same pixel PX1, and the second shielding conductive portion 120*b* is arranged between the first pixel electrode 131 of one pixel PX1 and the data line DL of another pixel PX2.

Pixels PXB may be used in place of the pixels PX of FIG. 1 to form another display apparatus 10B. The display apparatus 10B including the pixels PXB may also be driven by the foregoing drive system. The vertical cross-talk phenomenon may be relieved by the display apparatus 10B which includes the pixels PXB and is matched with the foregoing drive system.

Figure 7:
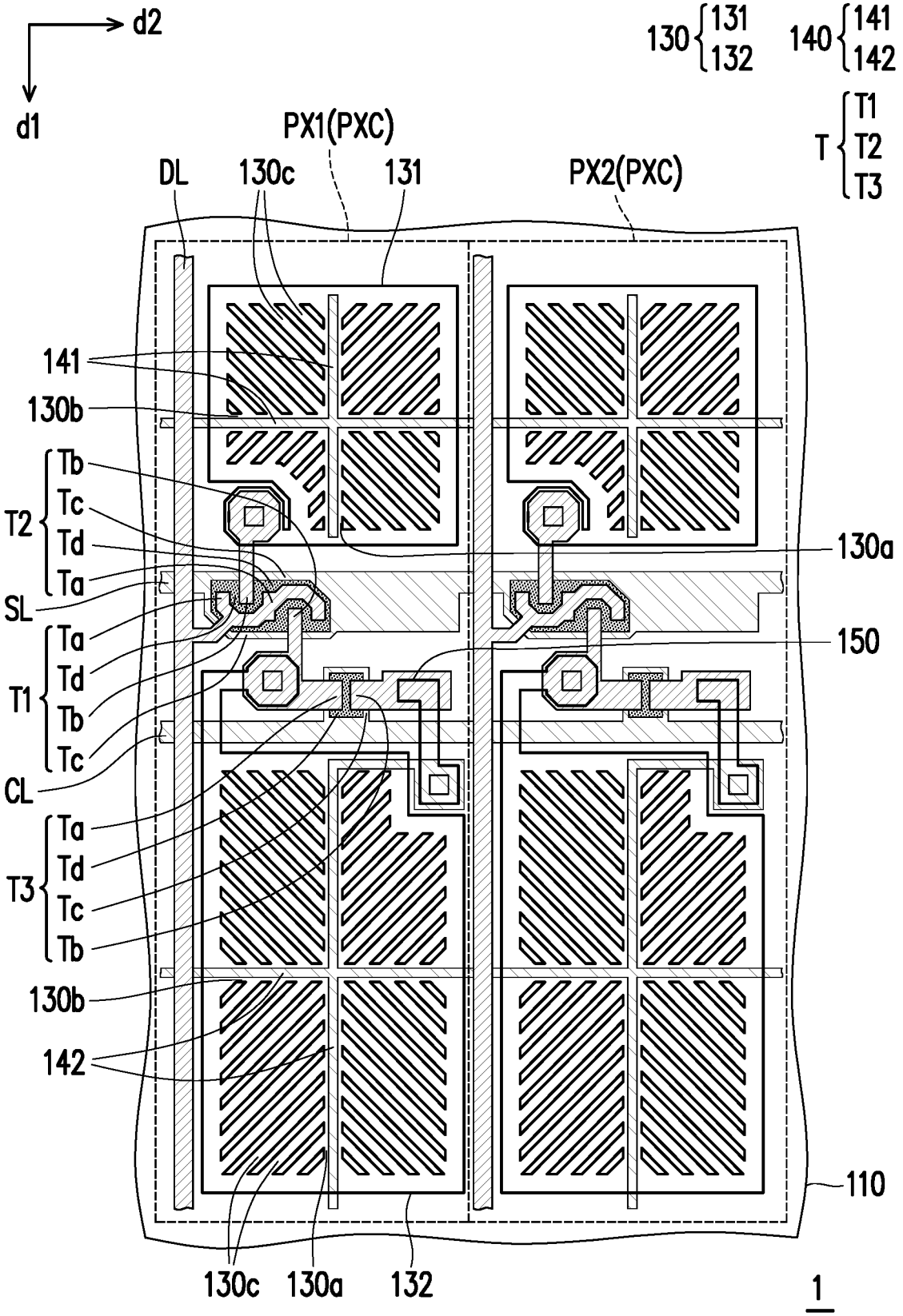
FIG. 7 is a layout diagram of a pixel PXC according to yet another embodiment of the disclosure.

FIG. 7 is a layout diagram of a pixel PXC according to yet another embodiment of the disclosure. Pixels PXC of FIG. 7 are similar to the pixels PXB of FIG. 6A and FIG. 6B, the difference between the pixels PXC of FIG. 7 and the pixels PXB of FIG. 6A and FIG. 6B is as follows: the pixels PXC of FIG. 7 do not include the shielding conductive patterns 120 of the pixels PXB of FIG. 6A and FIG. 6B. That is, in the embodiment of FIG. 7, no shielding conductive pattern extending in the first direction d1 is arranged between the data line DL and the first pixel electrode 131.

Pixels PXC of FIG. 7 may be used in place of pixels PX of FIG. 1 to form another display apparatus 10C. The display apparatus 10C including a plurality of pixels PXC may also be driven by the foregoing drive system. In particular, the pixels PXC do not include the shielding conductive patterns 120 and the display apparatus 10C has a high aperture ratio, and the vertical cross-talk phenomenon may be relieved on the premise of having the high aperture ratio by the display apparatus 10C matched with the foregoing drive system.

Figure 8:
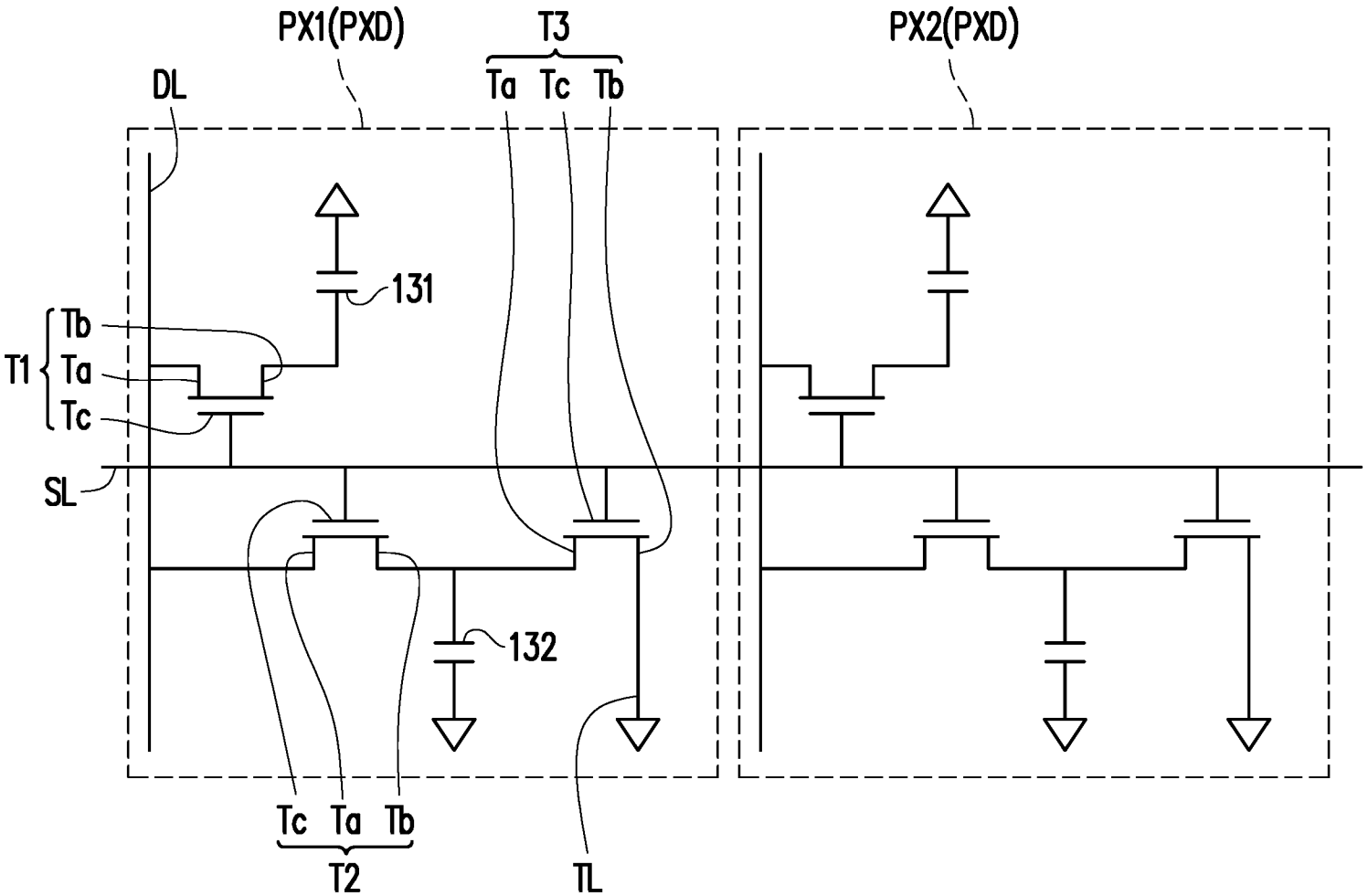
FIG. 8 is a circuit diagram of a pixel PXD according to an embodiment of the disclosure.

FIG. 8 is a circuit diagram of a pixel PXD according to an embodiment of the disclosure. Pixels PXD of FIG. 8 are similar to pixels PX of FIG. 3, and the difference between the pixels PXD of FIG. 8 and the pixels PX of FIG. 3 is as follows.

Referring to FIG. 8, in the present embodiment, each pixel PXD includes a scan line SL, a data line DL, a common line T1, a switching element T and a pixel electrode 130. The switching element T includes a first switching element T1, a second switching element T2 and a third switching element T3, and the pixel electrode 130 includes a first pixel electrode 131 and a second pixel electrode 132.

The first switching element T1 includes a control end Tc, a first end Ta and a second end Tb. The first end Ta of the first switching element T1 is electrically connected to the data line DL. The control end Tc of the first switching element T1 is electrically connected to the scan line SL. The first pixel electrode 131 is electrically connected to the second end Tb of the first switching element T1.

The second switching element T2 has a first end Ta, a second end Tb and a control end Tc. The first end Ta of the second switching element T2 is electrically connected to the data line DL. The control end Tc of the second switching element T2 is electrically connected to the scan line SL. The second end Tb of the second switching element T2 is electrically connected to the second pixel electrode 132.

The third switching element T3 has a first end Ta, a second end Tb and a control end Tc. The first end Ta of the third switching element T3 is electrically connected to the second end Tb of the second switching element T2. The control end Tc of the third switching element T3 is electrically connected to the scan line SL. The second end Tb of the third switching element T3 is electrically connected to the common line TL.

In the present embodiment, the pixel PXD includes a shielding conductive pattern (not shown) on an actual layout. The shielding conductive pattern is arranged between the data line DL of the pixel PXD and the first pixel electrode 131 of the pixel PXD. That is, at least a part of the vertical projection of the shielding conductive pattern on the substrate (not shown) is located between the vertical projection of the data line DL on the substrate and the vertical projection of the first pixel electrode 131 on the substrate.

The pixels PXD include pixels PX1 and pixels PX2 which are arranged and adjacent to each other in the second direction d2. For example, in the present embodiment, on an actual layout, the shielding conductive pattern (not shown) may include a first shielding conductive portion (not shown) and a second shielding conductive portion (not shown), the first shielding conductive portion is arranged between the data line DL and the first pixel electrode 131 of the same pixel PX1, and the second shielding conductive portion is arranged between the first pixel electrode 131 of one pixel PX1 and the data line DL of another pixel PX2.

Pixels PXD of FIG. 8 may be used in place of pixels PX of FIG. 1 to form another display apparatus 10D. The display apparatus 10D including a plurality of pixels PXD may also be driven by the foregoing drive system. The vertical cross-talk phenomenon may be relieved by the display apparatus 10D which includes the pixels PXD and is matched with the foregoing drive system.

Figure 9:
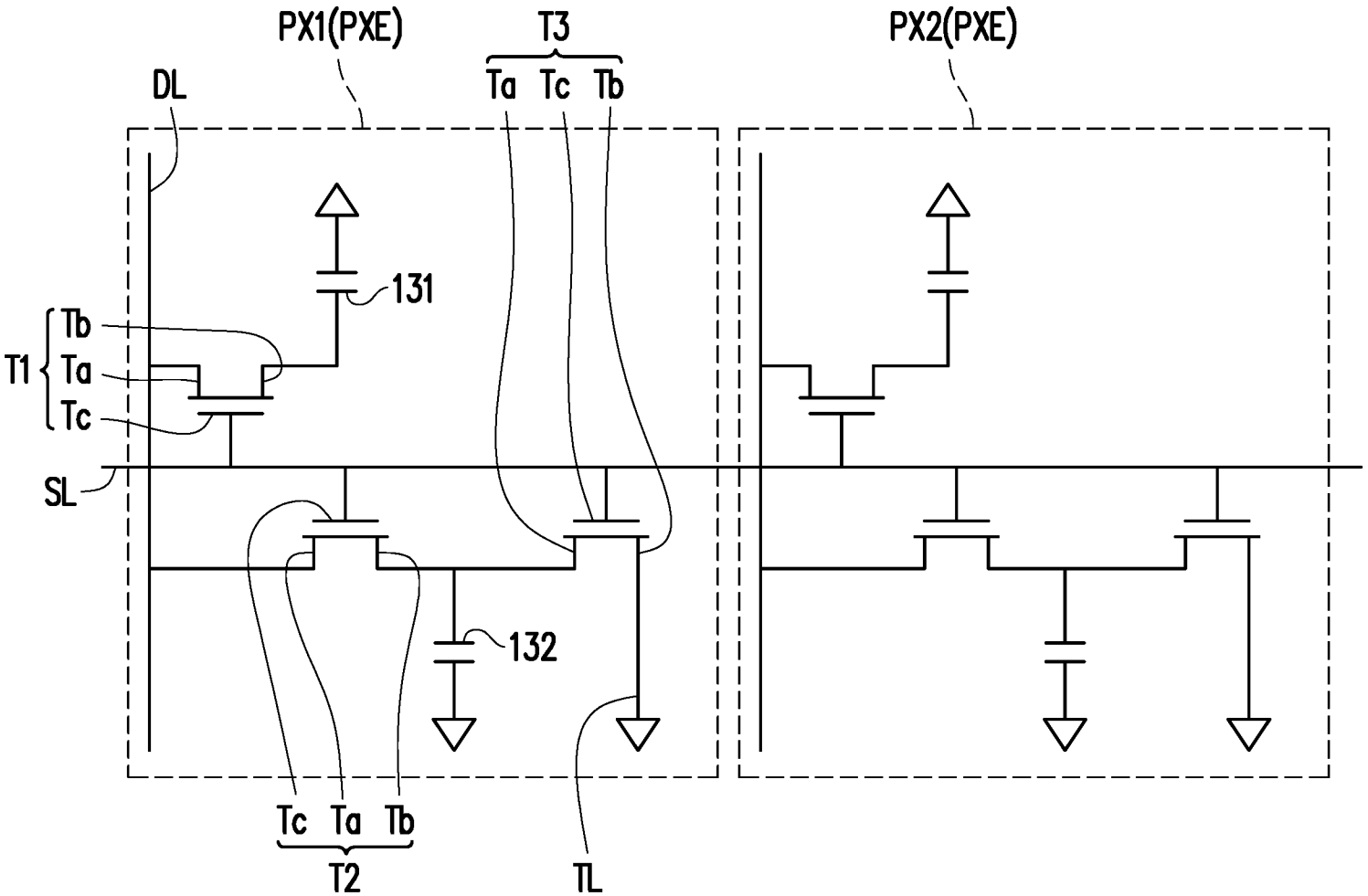
FIG. 9 is a circuit diagram of a pixel PXE according to another embodiment of the disclosure.

FIG. 9 is a circuit diagram of a pixel PXE according to another embodiment of the disclosure. Pixels PXE of FIG. 9 are similar to pixels PXD of FIG. 8, and the difference between the pixels PXE of FIG. 9 and the pixels PXD of FIG. 8 is as follows: the pixels PXE of FIG. 9 do not include the shielding conductive patterns of the pixels PXD of FIG. 8. That is, in the embodiment of FIG. 9, no shielding conductive pattern extending in the first direction d1 is arranged between the data line DL and the first pixel electrode 131.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display apparatus, comprising:

a substrate;

a plurality of pixels arranged on the substrate, wherein each of the pixels comprises:

a scan line;

a data line;

a first switching element having a first end, a second end, and a control end, wherein the first end of the first switching element is electrically connected to the data line, and the control end of the first switching element is electrically connected to the scan line; and a first pixel electrode electrically connected to the second end of the first switching element; and a gate driver, wherein the pixels include N pixels arranged in order, N is a positive integer greater than or equal to 2, the N pixels include a $p^{th}$ pixel and a $q^{th}$ pixel, p is an odd number less than or equal to N and a positive integer, and q is an even number less than or equal to N and a positive integer;

the gate driver being electrically connected to a scan line of the $p^{th}$ pixel, wherein the gate driver receives a first start signal to generate a first gate pulse signal in a first sub-frame interval of a frame interval;

the gate driver being electrically connected to a scan line of the $q^{th}$ pixel, wherein the gate driver receives a second start signal to generate a second gate pulse signal in a second sub-frame interval of the frame interval following the first sub-frame interval;

the first gate pulse signal comprising a first enabling time width, the second gate pulse signal comprising a second enabling time width, the first enabling time width being different from the second enabling time width.

2. The display apparatus according to claim 1, further comprising:

a data drive circuit electrically connected to a data line of the $p^{th}$ pixel and a data line of the $q^{th}$ pixel, wherein the data drive circuit respectively outputs a first data signal and a second data signal in the first sub-frame interval and the second sub-frame interval, and a polarity of the first data signal is opposite to a polarity of the second data signal.

3. The display apparatus according to claim 1, wherein the first enabling time width is W1, the second enabling time width is W2, and $0.05 \leq |W1-W2|/W1 \leq 0.30$.

4. The display apparatus according to claim 1, wherein a shielding conductive pattern exists between the data line of at least one of the pixels and the first pixel electrode of at least one of the pixels.

5. The display apparatus according to claim 1, wherein no shielding conductive pattern exists between the data line of at least one of the pixels and the first pixel electrode of at least one of the pixels.

6. The display apparatus according to claim 1, wherein each of the pixels further comprises:

a second switching element having a first end, a second end, and a control end;

a second pixel electrode, wherein the first end of the second switching element is electrically connected to the data line, the control end of the second switching element is electrically connected to the scan line, and the second end of the second switching element is electrically connected to the second pixel electrode;

a third switching element having a first end, a second end, and a control end, wherein the first end of the third switching element is electrically connected to the second end of the second switching element;

a control line, wherein the control end of the third switching element s electrically connected to the control line; and a charging updating capacitor, wherein the second end of the third switching element is electrically connected to the charging updating capacitor.

7. The display apparatus according to claim 6, wherein a shielding conductive pattern exists between the data line of at least one of the pixels and the first pixel electrode of at least one of the pixels.

8. The display apparatus according to claim 6, wherein no shielding conductive pattern exists between the data line of at least one of the pixels and the first pixel electrode of at least one of the pixels.

9. The display apparatus according to claim 1, wherein each of the pixels further comprises:

a second switching element having a first end, a second end, and a control end;

a second pixel electrode, wherein the first end of the second switching element is electrically connected to the data line, the control end of the second switching element is electrically connected to the scan line, and the second end of the second switching element is electrically connected to the second pixel electrode;

a third switching element having a first end, a second end, and a control end, wherein the first end of the third switching element is electrically connected to the second end of the second switching element, and the control end of the third switching element is electrically connected to the scan line; and a common line, wherein the second end of the third switching element is electrically connected to the common line.

10. The display apparatus according to claim 9, wherein a shielding conductive pattern exists between the data line of at least one of the pixels and the first pixel electrode of at least one of the pixels.

11. The display apparatus according to claim 9, wherein no shielding conductive pattern exists between the data line of at least one of the pixels and the first pixel electrode of at least one of the pixels.

12. A display apparatus, comprising:

a plurality of pixels, wherein each of the pixels comprises:

a scan line;

a data line;

a first switching element having a first end, a second end, and a control end, wherein the first end of the first switching element is electrically connected to the data line, and the control end of the first switching element is electrically connected to the scan line;

a first pixel electrode electrically connected to the second end of the first switching element;

a second switching element having a first end, a second end, and a control end;

a second pixel electrode, wherein the first end of the second switching element is electrically connected to the data line, the control end of the second switching element is electrically connected to the scan line, and the second end of the second switching element is electrically connected to the second pixel electrode;

a third switching element having a first end, a second end, and a control end, wherein the first end of the third switching element is electrically connected to the second end of the second switching element;

a control line, wherein the control end of the third switching element is electrically connected to the control line; and a charging updating capacitor, wherein the second end of the third switching element is electrically connected to the charging updating capacitor; and a gate driver, wherein the pixels include N pixels arranged in order, N is a positive integer greater than or equal to 2, the N pixels include a $p^{th}$ pixel and a $q^{th}$ pixel, p is an odd number less than or equal to N and a positive integer, and q is an even number less than or equal to N and a positive integer;

the gate driver being electrically connected to a scan line of the $p^{th}$ pixel, wherein the gate driver receives a first start signal to generate a first gate pulse signal in a first sub-frame interval of a frame interval;

the gate driver being electrically connected to a scan line of the $q^{th}$ pixel, wherein the gate driver receives a second start signal to generate a second gate pulse signal in a second sub-frame interval of the frame interval following the first sub-frame interval.

13. The display apparatus according to claim 12, further comprising:

a data drive circuit electrically connected to a data line of the $p^{th}$ pixel and a data line of the $q^{th}$ pixel, wherein the data drive circuit respectively outputs a first data signal and a second data signal in the first sub-frame interval and the second sub-frame interval, and a polarity of the first data signal is opposite to a polarity of the second data signal.

14. The display apparatus according to claim 12, wherein the first gate pulse signal comprises a first enabling time width, the second gate pulse signal comprises a second enabling time width, and the first enabling time width is different from the second enabling time width.

15. The display apparatus according to claim 14, wherein the first enabling time width is W1, the second enabling time width is W2, and $0.05 \leq W1-W2/W1 \leq 0.30$.

16. The display apparatus according to claim 12, wherein a shielding conductive pattern exists between the data line of at least one of the pixels and the first pixel electrode of at least one of the pixels.

17. The display apparatus according to claim 12, wherein no shielding conductive pattern exists between the data line of at least one of the pixels and the first pixel electrode of at least one of the pixels.

* * * * *